United States Patent [19]

Agulnick

[11] 4,267,611

[45] May 19, 1981

[54] INFLATABLE MASSAGING AND COOLING MATTRESS

[76] Inventor: Arnold Agulnick, 33 Wales Ave., Avon, Mass. 02322

[21] Appl. No.: 18,720

[22] Filed: Mar. 8, 1979

[51] Int. Cl.[3] ..... A61H 7/00; A47G 27/08

[52] U.S. Cl. ..... 5/453; 5/455; 5/469; 128/33

[58] Field of Search ..... 5/449, 450, 453, 454, 5/455, 456, 462, 468, 469, 421, 422, 423; 297/DIG. 3; 128/33, 38, 376

[56] References Cited

U.S. PATENT DOCUMENTS

| | | | |
|---|---|---|---|
| 2,998,817 | 9/1961 | Armstrong | 5/422 |
| 3,199,124 | 8/1965 | Grant | 5/453 |
| 3,653,083 | 4/1972 | Lapidus | 5/469 |
| 4,161,794 | 7/1979 | Darnfors | 5/455 |

FOREIGN PATENT DOCUMENTS

| | | | |
|---|---|---|---|
| 823166 | 11/1959 | United Kingdom | 5/498 |
| 949652 | 2/1964 | United Kingdom | 5/469 |

*Primary Examiner*—Alexander Grosz

*Attorney, Agent, or Firm*—Wolf, Greenfield & Sacks

[57] ABSTRACT

An inflatable mattress having top and bottom sheets of thin vinyl material heat-sealed together to form a plurality of transversely extending inflatable ribs. The ribs are generally arcuate in shape so as to have a directional component in the longitudinal direction of the mattress. The ribs are arranged in two groups, each composed of alternate ribs, and the groups are alternately inflated.

6 Claims, 9 Drawing Figures

PUMP
64
62
66
68
22
24
10
16
23'
28
30
42
50
34
52
23"
32
23Y
23Z
18D
18C
18B
18A
23A
23B
23C
18
44
6
2
20
40
14
23
36
4
5

50
14
18

3
18
23
14
16
32
12
52
56
53
54
60
58

23G
14
50
23H
23I
23J
23K
21
18
12
54

INFLATABLE MASSAGING AND COOLING MATTRESS

INTRODUCTION

This invention relates to inflatable mattresses and more particularly comprises a mattress designed to massage and cool the body to prevent the development of decubitus ulcers, commonly known as bed sores. The mattress is suitable for use in hospitals and nursing homes as well as in the home.

Until now, no mechanical system successfully addressed the three most common causes for decubitus ulcers—namely, unrelieved pressure, disrupted peripheral circulation and moisture buildup. While inflatable mattresses for combating the development of decubitus ulcers have been on the market for some time, none has proved wholly successful.

One popular inflatable mattress of this type available in the United States is marketed by American Hospital Supply Corporation and is shown in Lapidus U.S. Pat. No. 3,653,083 dated Apr. 4, 1972 and entitled Bed Pad. The mattress includes a pair of plastic sheets which are heat-sealed together to form transversely extending tubes, with the tubes arranged in two pairs or groups which are alternately inflated and deflated. The upper of the two sheets is provided with perforations that enable the air in the tubes to escape, which air may be used to cool the body. The same concept is shown in the earlier Armstrong U.S. Pat. No. 2,998,817 dated Sept. 5, 1961 and entitled Inflatable Massaging and Cooling Mattress.

The American Hospital Supply Corporation product has certain features which are undesirable, and it lacks other features which would enhance its performance. For example, the American Hospital product does not include means for anchoring the mattress in place on the conventional hospital mattress. Consequently, when the mattress is elevated to bring the patient to a sitting or semisitting position, the inflated mattress tends to slide toward the foot of the bed. Furthermore, the inflatable tubes of the product extend straight across the mattress, and therefore there is no component of force exerted by the expanding tubes longitudinally of the patient's body in the direction of body circulation. As a result the massaging action of the mattress is of limited value. Furthermore the air holes which allow the tubes to deflate are quite large, and, therefore, body fluids are allowed to enter and accumulate in the inflatable mattress tubes, and the fluid cannot readily be removed. As yet another disadvantage, the American Hospital Supply Corporation inflatable mattresses are used with disposable pads, and the pads are bulky, have a very limited life, and add to the expense of the system and very limited massaging action can be accomplished through the pads.

In accordance with the present invention the air tubes have a directional component which extends longitudinally of the mattress, and, therefore, as the tubes are inflated, they apply a pressure to the patient's body in the direction of blood circulation in the body. Furthermore, the mattress includes means for anchoring the unit to the regular bed mattress, and consequently it does not slip when the bed is elevated to raise the patient to a sitting or semi-sitting position. The controls for the inflation system are at the head of the bed where they may be conveniently operated by the attendant. The holes provided in the tubes which enable the tubes to deflate when the air pressure is cut off are very small so as to essentially prohibit any body fluids from entering the interior of the mattress. Consequently the mattress may be made of transparent material—there is no need to hide or disguise the interior. Furthermore, no bulky pads are required with the use of the mattress of the present invention, so that costs are reduced and handling is made easier.

These and other objects and features of this invention will be better understood and appreciated by the following detailed description of several embodiments thereof.

BRIEF FIGURE DESCRIPTION

Figure 1:
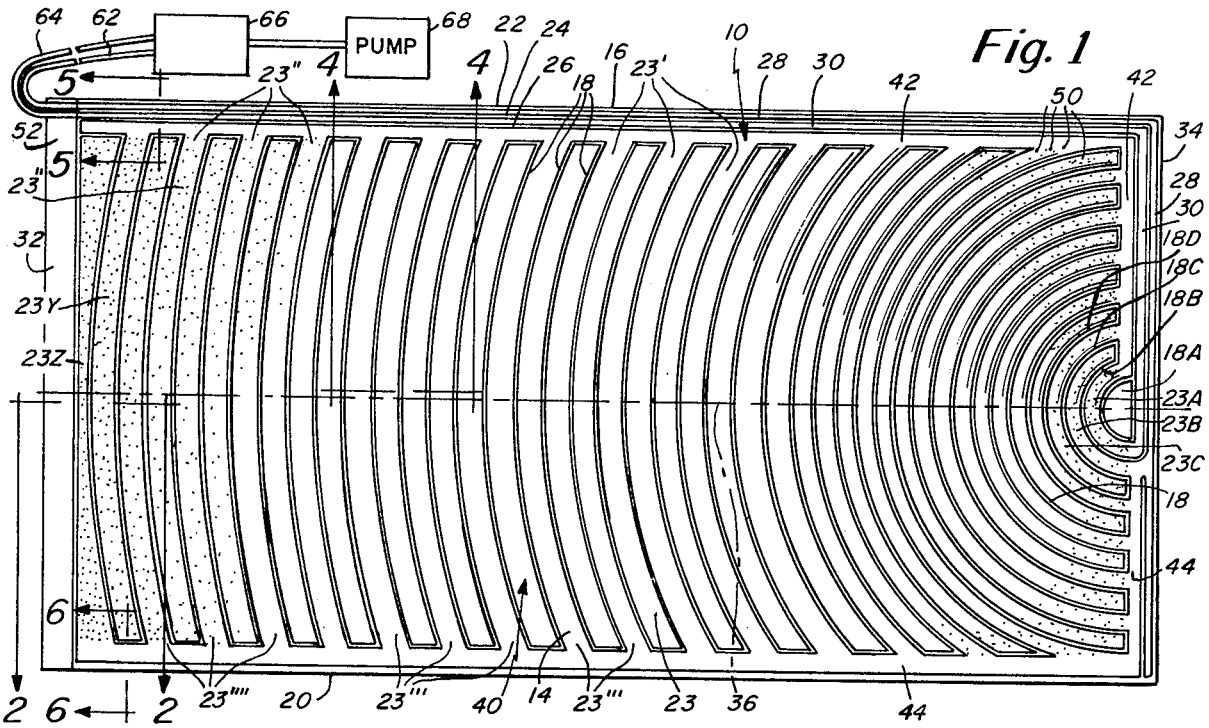
FIG. 1 is a plan view of an inflatable mattress constructed in accordance with this invention.
Figure 5:
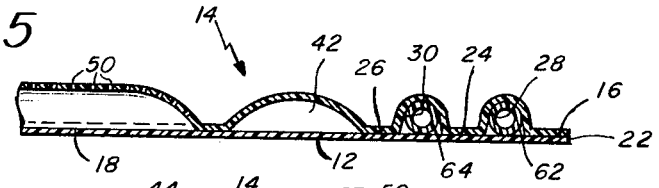
Figure 6:
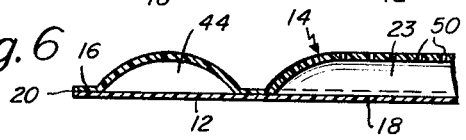
Figure 7:
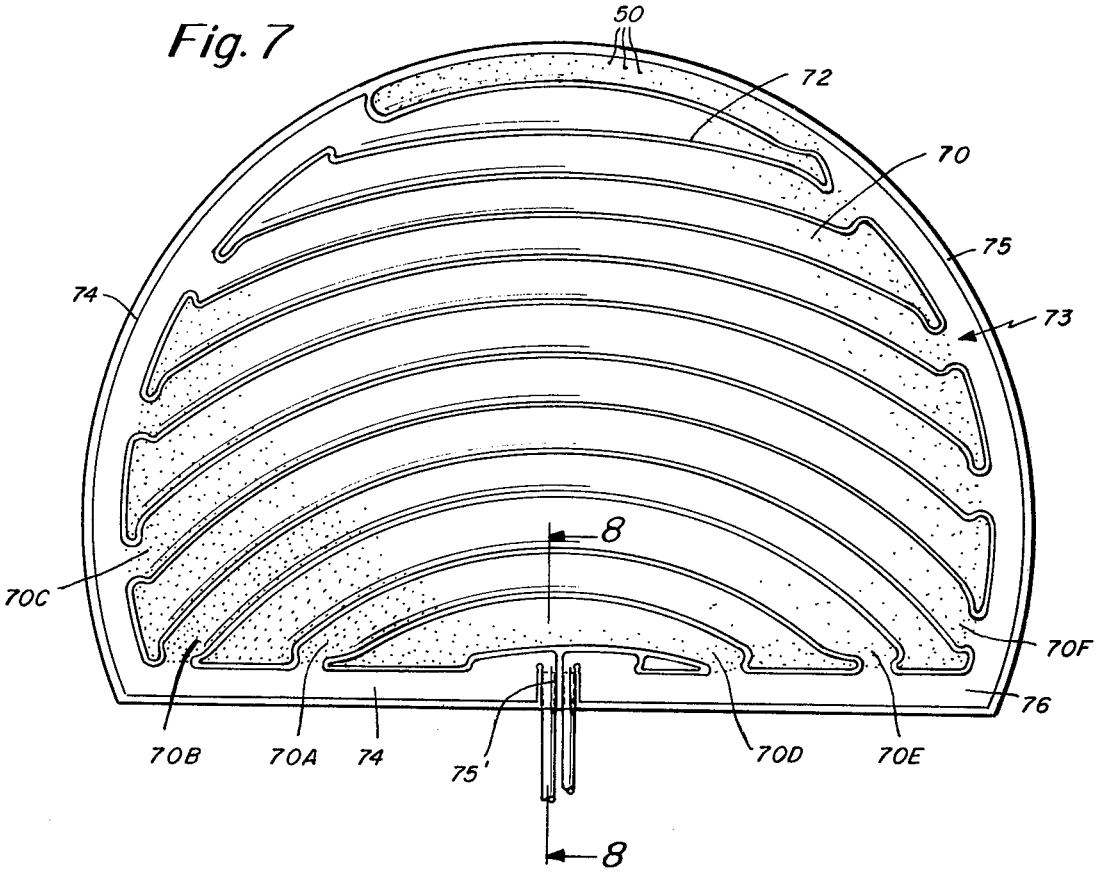
Figure 8:
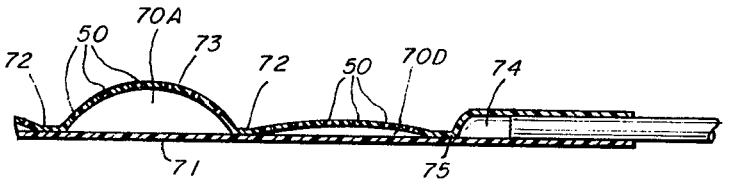
Figure 9:
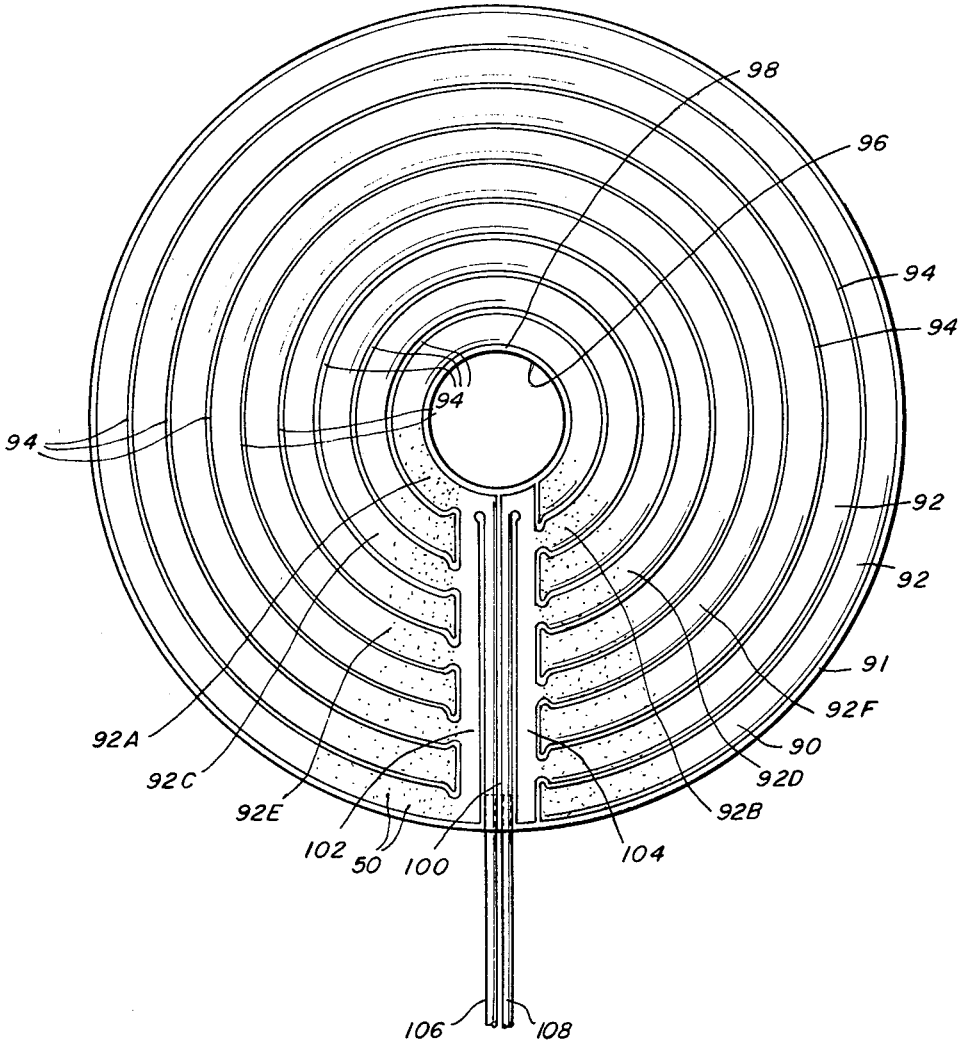

FIGS. 5 and 6 are fragmentary cross-sectional views taken respectively on section lines 5—5 and 6—6 of FIG. 1;

FIG. 7 is a plan view of an inflatable cushion constructed in accordance with this invention;

FIG. 8 is a cross-sectional view of the cushion taken on section line 8—8 of FIG. 7; and FIG. 9 is a plan view of an inflatable pad constructed in accordance with this invention.

DETAILED DESCRIPTION

The inflatable mattress 10 shown in FIGS. 1-6 is made of a pair of thin vinyl sheets 12 and 14, which typically may be in the order of 0.012 inch in thickness. Sheet 12 comprises the bottom sheet of the mattress while sheet 14 defines the upper surface. The two sheets are joined together by a heat-sealed peripheral seam 16. A number of arcuate seams 18 define a plurality of arcuate inflatable ribs 23 closed at one side of the mattress and open at the other. These arcuate seams and inflatable ribs are described with greater particularly below.

A pair of spaced, parallel heat-sealed seams 24 and 26 join the lower and upper sheets 12 and 14 along the side edge 22 so as to define with the peripheral seam 16 a pair of ducts 28 and 30 which extend from the head to the foot of the mattress. In FIG. 1, the head end of the mattress is identified by reference character 32 and the foot by reference character 34. The seams 24 and 26 also are provided approximately half way across the foot 34 of the mattress so as to extend the ducts 28 and 30 to the center of the foot end 34.

The arcuate seams 18 that traverse the mattress are generally symmetrical about the center line 36 and in fact are formed as one continuous seam that snakes back and forth across the mattress starting with a relatively small radius at the foot 34 and progressively increasing in radius as the seam approaches the head 32. Thus, as viewed in FIG. 1, beginning at the foot 34, a first arcuate rib 23A is formed between arcuate seams 18A and 18B, a second arcuate rib 23B of slightly greater radius is formed between seams 18B and 18C, a third rib 23C of even greater radius is formed between seams 18C and 18D etc. It is evident that the radii of the inflatable ribs as they move away from the foot 34 generally increase so that the ribs which lie in the central portion 40 of the mattress have a substantially larger radius than the ribs at the foot 34. The radii of the ribs across the central portion 40 and at the head end 32 of the mattress are generally constant.

It will be noted in FIGS. 1, 5 and 6 that the serpentine configuration of the continuous heat-sealed seam 18 defines a manifold 42 along side edge 22 and a manifold 44 along side edge 20 and that the respective manifolds communicate with alternate ribs 23 of the array of ribs along the full length of the mattress. Manifold 42 begins at the foot 34 of the mattress at the approximate center thereof and extends along the foot to the side 22. Thus, the manifold 42 is in direct communication with ribs 23A, 23C, 23E, etc. that is, every other rib in the mattress. In the central and head portions of the inflatable mattress, those ribs are identified as ribs 23' and 23'' respectively. Manifold 44 which extends from the center of the foot 34 of the mattress to the side 20 and then along the side 20 to the head 32 communicates with inflatable ribs 23B, 23D, 23F, etc. as well as with the ribs 23''' and 23'''' in the central and head portions 40 and 32, respectively of the mattress.

In FIG. 1 the inflatable ribs 23' and 23''' disposed in the central portion 40 of the mattress are shown to be somewhat larger than the ribs disposed at the foot and head portions of the mattress. The ribs may for example be approximately 1 13/16 inches wide in the central portion 40 and be approximately 1 5/16 inches wide at the foot and head areas. The larger sized ribs 23' and 23''' disposed at the central portion of the mattress provide firmer support for the body at its central portion where somewhat greater weight is concentrated.

Figure 3:
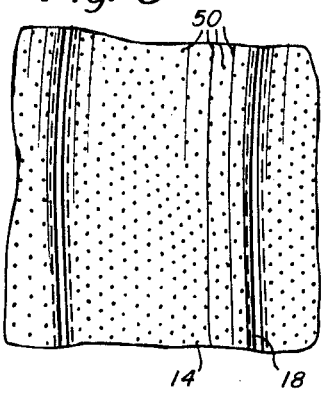
FIG. 3 is a fragmentary top view of the inflatable mattress taken along sight line 3—3 of FIG. 2.
Figure 2:
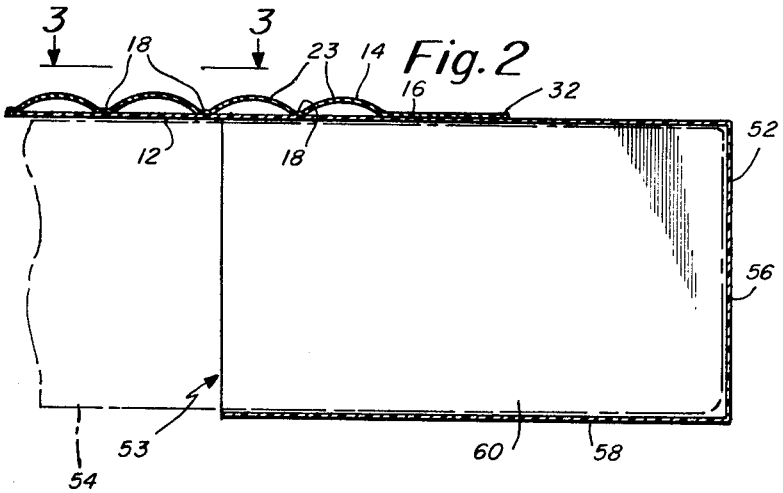
FIG. 2 is a fragmentary cross-sectional view of the mattress of FIG. 1 and showing the inflatable mattress as having a pocket at its head end which holds the inflatable mattress on a conventional mattress.
Figure 4:
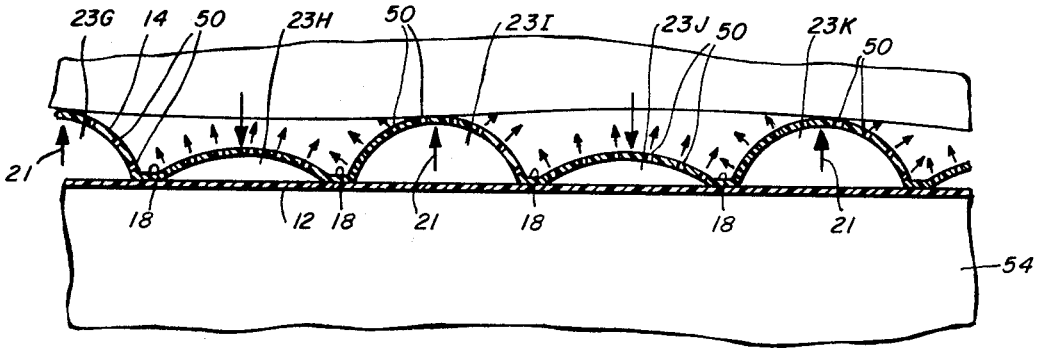
FIG. 4 is a fragmentary cross-sectional view of the mattress taken on section line 4—4 of FIG. 1 and further suggesting a body supported on it.

The upper sheet 14 of the mattress is covered with an array of very small perforations 50 preferably in the order of 0.001 inch in diameter. These holes are so small that they essentially prevent the flow of any fluid from outside the mattress into the ribs. The array of perforations 50 as shown in FIG. 3 are, however, large enough to allow air to escape from the inside of the mattress ribs so as to enable the ribs to deflate when air is not being pumped into them.

In accordance with the preferred form of this invention the lower sheet 12 is somewhat larger than the upper sheet 14 so that the bottom sheet extends beyond the top sheet to form an envelope 52 of single ply at the head 32. The envelope enables the inflatable mattress to be anchored firmly to the conventional mattress on which the inflatable mattress is placed. When it is properly tucked under the heavy conventional mattress and that mattress is then elevated to place the patient in a sitting or semi-sitting position, the inflatable mattress will not slide toward the foot of the bed. The envelope is contoured to form a pocket 53 along the head 32 of the inflatable mattress, which pocket receives the conventional hospital mattress. This is suggested in FIG. 2 wherein the envelope 52 is shown to extend about and under the regular mattress 54 so as to prevent the inflatable mattress from sliding to the left as viewed in that figure. In this arrangement, the envelope 52 is contoured to provide a vertical top panel 56, a bottom panel 58 and side panels 60 which together define the pocket which receives the head end of the conventional mattress.

In the preferred embodiment shown in FIGS. 1-6 a pair of inflation tubes 62 and 64 connected through a control box 66 to a compressor 68, extend through the ducts 28 and 30 respectively so as to carry the air under pressure directly to the inlet end of each of the manifolds 42 and 44. It will be noted that the control box 66 is at the head end of the bed while the air which discharges from the tubes 62 and 64 does so at the foot of the bed remote from the patients head. Consequently the air noise generated by the flow of air is sufficiently removed from the patient so as not to disturb him.

In accordance with the present invention, the mattress is intended to be used on top of a conventional mattress and is anchored in place by means of the envelope 52 as described above. When pump 68 is turned on by means of the control box 66, the ducts 62 and 64 alternately receive air from the pump 68 for a period of approximately 22½ seconds, at a flow rate of approximately 2 cubic feet per minute. The control box, whose details form no part of the present invention, may typically include a rotary distribution valve driven by an electric motor. In the embodiment shown, when duct 62 receives air from the pump, the ribs open to the manifold 44 are inflated, while during the other half cycle when the duct 64 receives the air under pressure, the ribs open to the manifold 42 are inflated. During the half cycle that the ribs are not being inflated, they deflate by the escape of air from them through the perforations 50. Thus, in FIG. 4, the ribs 23G, 23I and 23K are shown being inflated as suggested by the arrows 21, while the ribs 23H and 23J are deflating as the air escapes through the perforations 50.

Because all of the air which enters the manifolds 42 and 44 does so at the foot of the mattress, the ribs nearer the foot inflate first, and the inflation gradually spreads toward the head. Thus, inflation begins at the foot end and there is a slight time delay between the inflation of the first rib 23A, and the last rib 23Y connected to the manifold 42. Similarly, the ribs 23Z will not become fully inflated until sometime after the rib 23B is fully inflated from manifold 44.

Because each of the ribs is arcuate in shape, as the air spreads through them from the manifolds at the mattress sides, the air generates a component of force in the longitudinal direction of the mattress from the foot to the head. This direction of the applied force produces a positive massaging action in the direction of blood circulation. Furthermore, because of the smaller cross-sectional area of the inflatable ribs at the foot of the mattress where the legs are supported, a more rapid massaging action is provided in that region because the rate of flow of air is greater through those smaller ribs. This is particularly desirable because the legs are farthest from the heart and generally are subject to the greater circulation problems.

The embodiment of this invention shown in FIGS. 7 and 8 is in the form of a generally semi-circular cushion which may provide local massaging action. For example, the cushion may be provided as a seat in a hospital chair and assist in the flow of blood back to the heart. In this embodiment, the cushion may typically be 20 inches in diameter, and the ribs 70 may be approximately 1 5/16 inches wide. The cushion itself is composed of two sheets of vinyl 71 and 73 heat-sealed together about their periphery as shown at 75, just as in the embodiment of FIGS. 1-6. The ribs 70 provided in the cushion are defined by the serpentine seam 72 that extends back and forth in arcs across the cushion to define ribs alternately open at opposite ends. Thus, inflatable ribs 70A, B and C are shown open at the left end of the cushion in communication with manifold 74 formed on that side, while the inflatable ribs 70D, E and F are shown open to the manifold 76 on the other side of the cushion. The manifolds 74 and 76 are separated by a heat-sealed seam 75' at the center line of the cushion at its periphery. Tubes connected to the two manifolds 74 and 76 will alternately provide air under pressure to each so as to cause alternate inflation of the cushion ribs. As in the first described embodiment, the upper sheet of material is covered with perforations 50 to allow the air to bleed from the ribs.

The embodiment of this invention shown in FIG. 9 is in the form of a circular pad to support a localized area of the body. In this embodiment, two circular sheets 90 are heat-sealed together about their periphery as shown at 91 and concentric inflatable ribs 92 are formed in the pad by concentric heat-sealed seams 94. A hole 96 is provided in the mattress at its center, and its periphery is sealed by a heat-sealed seam 98 so that the pad is generally donut shaped. The hole may typically be 5 inches in diameter. A radial seam 100 extends from the center seam 98 to the seam 90 at the periphery of the pad to define a pair of manifolds 102 and 104, each connected to alternate ribs in the circular array. A pair of inflation tubes 106 and 108 are connected to the manifolds 102 and 104 respectively, and each is provided to alternately direct the air to its respective manifold. Thus, when duct 106 is connected by means of its control box (not shown) to the air pump (not shown), the inflatable ribs 92A, 92C, 92E, etc. are inflated, while the duct 108 when operatively connected to the pump will inflate the alternate ribs 92B, 92D, 92F, etc. As in the other embodiments of this invention, the upper surface of the mattress is covered with perforations so as to allow the air to bleed from the ribs so as to enable them to deflate when not directly connected to the pressure source.

The pad shown in FIG. 9 is particularly suitable for use with incontinent patients. An absorbent material may be placed under the pad, and the opening at the center may be used to collect urine while the inflated ribs supports the patient above the liquid and absorbent material. Thus, the central cut out section essentially forms a well for the collection of liquid. Another use for the pad of FIG. 9 is to support a localized area of the body having particularly sensitive ulcerations. The opening 98 may be aligned with the ulcer, and the sequential inflation of the ribs will provide a massaging action around the particularly painful area.

Having described this invention in detail, those skilled in the art will appreciate the many advantages derived from such a construction. In the mattress form of this invention, quiet and dependable action is provided by means of the location of the entry of the air from the ducts into the manifolds so as not to disturb the patient. The mattress is provided with a fitted configuration at the head end so that a change in bed elevation will not cause the mattress to slip and create shear problems. The hundreds of tiny holes which cover the upper surface gently circulate air under the patient so as to alleviate heat buildup and perspiration problems. And the pattern of arcuate ribs corresponds best to body weight distribution and provides positive massaging action to stimulate blood circulation. The assembly is ruggedly built and will not be effected by pin holes and other small punctures.

Because numerous modifications may be made of this invention without departing from its spirit, I do not intend to limit the breadth of this invention to the embodiments illustrated and described. Rather, it is intended that the scope of this invention be determined by the appended claims and their equivalents.

What is claimed is:

1. An inflatable mattress comprising:

a top and a bottom sheet having head and foot ends and opposite sides, said sheets being heat-sealed together to form a plurality of inflatable ribs each extending from one side to the other and transversely of the body of the person lying on the mattress, said ribs being closed at one end and open at the other, alternate ribs having their open ends on one side of the mattress and the remaining ribs having their open ends on the other side of the mattress, said sheets being made of a thin and flexible material so that the sheets collapse upon one another when the ribs are deflated, said ribs being arcuate in shape with the portion of each rib intermediate the sides lying closer to the head end of the mattress than the ends of the ribs so as to create in each rib a directional component perpendicular to the transverse direction of the mattress and toward the head end, manifolds formed between the sheets by heat-sealed seams between them, one manifold extending along each side of the mattress, said manifolds being connected to the open ends of the ribs on their respective sides of the mattress, and means for introducing air under pressure alternately into first one manifold and then the other manifold and causing the ribs connected to each manifold to be inflated sequentially from one end of the mattress to the other.

2. An inflatable mattress as defined in claim 1 further characterized by the means for introducing air into the manifold comprising a duct connected to the manifold at the foot end of the mattress, and means at the head end of the mattress for connecting said duct to a source of compressed air.

3. An inflatable mattress as defined in claim 1 further characterized by one of said sheets being larger than the other so as to include an extension at one end beyond said other sheet, said extension being formed into contoured corners to anchor the inflatable mattress on top of a conventional mattress.

4. An inflatable mattress as defined in claim 1 further characterized by the cross sectional area of the ribs being larger at the central portion of the mattress than at the foot and head portions thereof.

5. An inflatable mattress as defined in claim 1 further characterized by the upper sheet having a plurality of small apertures in the order of 0.001 in diameter to permit air to exit from the ribs, said apertures being so small as to essentially prevent fluids from passing from outside the sheets to the interior of the ribs.

6. An inflatable mattress as defined in claim 1 further characterized by each of said ribs being symmetrical with respect to the center line of the sheets that runs from the head end to the foot end thereof.

* * * * *